US005768705A

United States Patent [19]

McCloud

[11] Patent Number: 5,768,705

[45] Date of Patent: Jun. 23, 1998

[54] INFLATABLE SAFETY APPARATUS

[76] Inventor: Nedra McCloud, 3005 Beverly Rd., Austin, Tex. 78703

[21] Appl. No.: 821,968

[22] Filed: Mar. 11, 1997

[51] Int. Cl.[6] ..... B63B 35/58; A41D 1/00; B54C 25/00

[52] U.S. Cl. ..... 2/69; 441/40; 244/138 R

[58] Field of Search ..... 2/69, DIG. 3; 441/40, 87, 103, 129, 136; 182/129, 137; 114/345, 349; 244/138 R

[56] References Cited

U.S. PATENT DOCUMENTS

| | | | |
|---|---|---|---|
| 1,113,074 | 10/1914 | Voegeli | 441/109 |
| 1,129,108 | 2/1915 | McKelvy | 441/87 |
| 1,129,958 | 3/1915 | Collins | 441/87 |
| 1,982,913 | 12/1934 | Hansen | 114/345 X |
| 2,363,249 | 11/1944 | Hutchinson | 441/87 X |
| 2,762,047 | 9/1956 | Flagg et al. | 2/DIG. 3 |
| 2,854,049 | 9/1958 | Wyllie | 441/40 X |
| 2,987,735 | 6/1961 | Nail | 441/40 X |
| 3,037,218 | 6/1962 | Brooks | 441/40 X |
| 3,428,978 | 2/1969 | Johnson | 441/87 X |
| 3,768,467 | 10/1973 | Jennings | 441/40 X |
| 3,851,730 | 12/1974 | Scurlock | 182/137 |
| 3,930,667 | 1/1976 | Osuchowski et al. | 280/150 |
| 3,972,526 | 8/1976 | Cox, Jr. | 272/1 D |
| 4,059,852 | 11/1977 | Crane | 2/2 |
| 4,286,439 | 9/1981 | Pasternack | 62/259.3 |
| 4,597,450 | 7/1986 | Budmiger | 169/50 |
| 4,737,994 | 4/1988 | Galton | 2/2 |
| 4,942,839 | 7/1990 | Chuan | 441/40 X |
| 4,977,623 | 12/1990 | DeMarco | 2/69 |
| 5,088,115 | 2/1992 | Napolitano | 2/69 |
| 5,150,767 | 9/1992 | Miller | 182/137 |
| 5,203,427 | 4/1993 | Williams, Sr. et al. | 182/129 |
| 5,206,958 | 5/1993 | Widenback | 2/88 |
| 5,283,916 | 2/1994 | Haro | 441/40 X |
| 5,309,571 | 5/1994 | Huang | 2/81 |
| 5,468,167 | 11/1995 | Givens | 441/40 |
| 5,570,480 | 11/1996 | Yeung | 441/87 X |
| 5,662,506 | 9/1997 | Reinhardt et al. | 441/40 |

*Primary Examiner*—C. D. Crowder
*Assistant Examiner*—Shima L. Jenkins
*Attorney, Agent, or Firm*—Goldstein & Associates

[57] ABSTRACT

An inflatable safety apparatus comprising an exterior shell and a chamber located inside the exterior shell. Inflation means, capable of inflating the apparatus are contained within the exterior shell. A tether is secured to the inflation means. In the event of an emergency at a high altitude location, an individual secured an end of the tether to a fixed object at the location, enters the chamber and exits the location via a window or balcony to free-fall to the ground below. As the tether becomes taught and disengages the inflation means, the inflation means are actuated and cause the exterior shell to fill with gas and inflate. When the apparatus strikes the ground, the individual contained within the chamber is unharmed due to the protective layer of gas which surrounds the chamber and is contained by the exterior shell.

2 Claims, 3 Drawing Sheets

INFLATABLE SAFETY APPARATUS

BACKGROUND OF THE INVENTION

The invention relates to an inflatable safety apparatus. More particularly, the invention relates to an apparatus which, when in a deflated state, may be entered by an individual to assist the individual in free-falling from a dangerous height in order to escape fire or other dangers, when the only means of egress from such a dangerous situation is to leap from a great height towards the ground.

Occasionally, individuals find themselves trapped in a location where, in order to escape imminent harm or death, they must leap from a high altitude towards the ground (i.e. from a hotel or office building window). Typically, the situation forces the individual to choose between almost certain harm or death from the fire or other danger which may be present, and the potential danger which will result from the individual's plummet to the ground. The choice is often simple—the individual escapes by exiting from a window or balcony. All too often, however, the individual sustains injuries as a result of the fall which are greater to or worse than the injuries that would have been caused by the fire or other danger from which he escaped.

In an attempt to lessen the injuries suffered by an individual leaping from a high altitude, rescue services and fire departments often construct safety nets or mattresses on the ground below the individual. Typically, these devices comprise some sort of air mattress or interlaced rope-net which must be erected and placed strategically below the individual's path of fall. If the device is misplaced even slightly, the individual sustains severe injuries. In addition, the device might instill a false sense of security in the individual, thus causing him to leap from a great a height when possibly not warranted. Finally, these devices fail to provide even a minimal level of safety if the rescue teams fail to arrive at the emergency scene early enough.

While these units may be suitable for the particular purpose employed, or for general use, they would not be as suitable for the purposes of the present invention as disclosed hereafter.

SUMMARY OF THE INVENTION

It is an object of the invention to produce an inflatable safety apparatus.

It is another object of the invention to produce an inflatable safety apparatus which may be transported simply and safely, and carried by an individual to preferred locations.

It is a further object of the invention to produce an inflatable safety apparatus which may be conveniently stored in office buildings and hotels adjacent to windows, balconies and other potential means of egress which are typically utilized by an individual attempting to escape a fire or other dangerous circumstance.

It is a still further object of the invention to produce an inflatable safety apparatus which is transported or stored in a convenient and compact deflated state, yet capable of inflating in response to an emergency.

It is yet another object of the invention to produce a device which an individual may enter and utilize to transport said individual safely towards the ground from a high altitude, such as a window or balcony of a multi-level building, upon escaping a fire or other danger.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMBERS IN DRAWINGS

Figure 1:
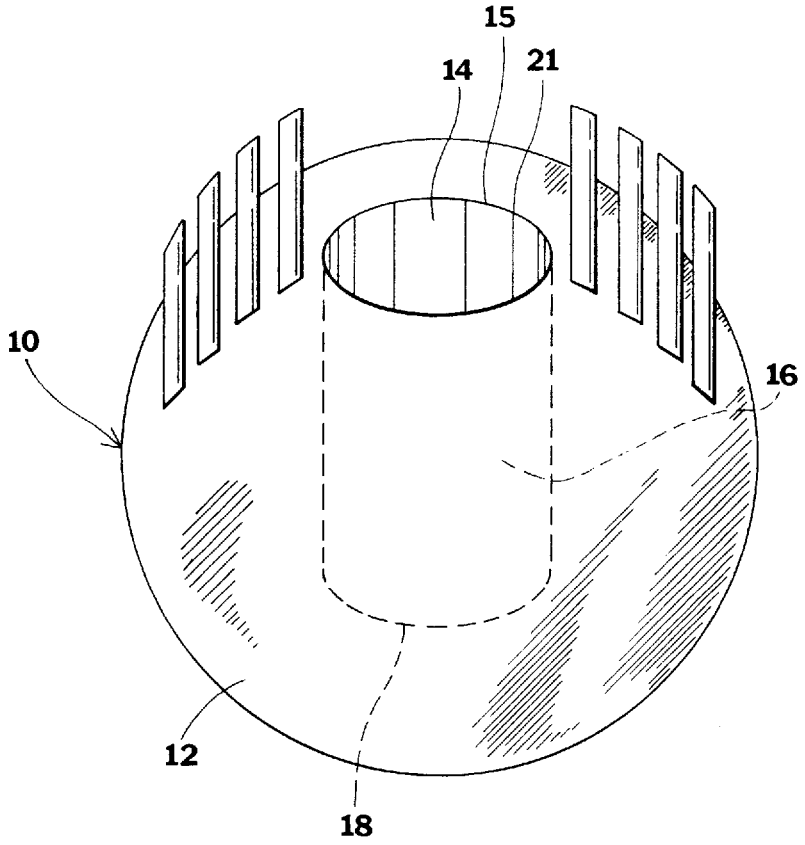
FIG. 1 is a diagrammatic perspective view of the inflatable safety apparatus in an inflated state, with a protective interior chamber depicted in the center thereof.
Figure 2:
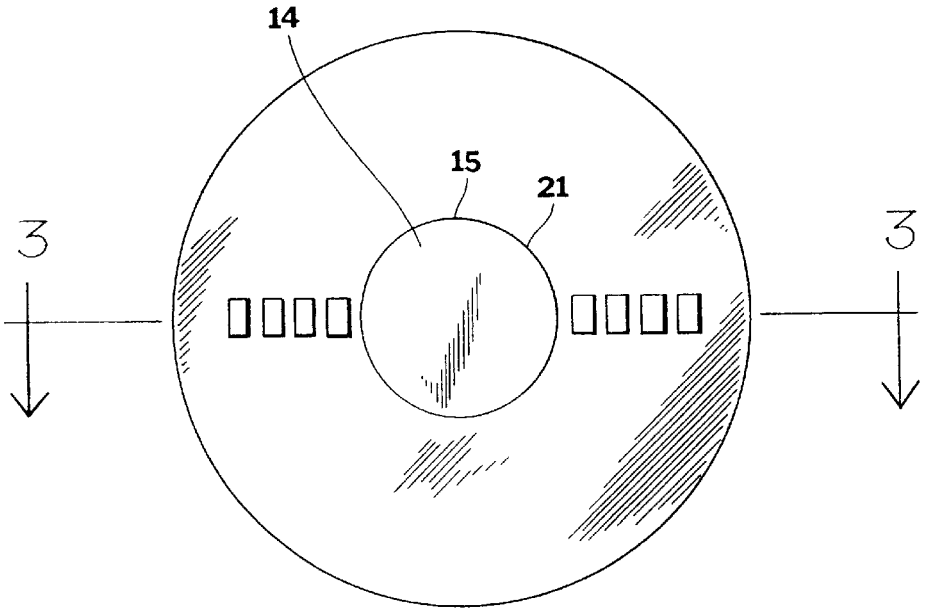
FIG. 2 is a top view of the inflatable safety apparatus.

Inflatable safety apparatus 10
Exterior shell 12
  Shell opening 14
  Shell opening perimeter 15
Chamber 16
  Bottom end 18
  Open end 20
  Open end perimeter 21
Interior shell region 22
Interior chamber region 24
Inflation means 26
Tether 28
  Interior end 29
  Exterior end 30
Stabilizing streamers 32
Braces 34

DETAILED DESCRIPTION OF THE PREFERRED EMBODIMENTS

FIG. 1 illustrates an inflatable safety apparatus 10 shown in an inflated state. The same inflatable safety apparatus 10 is shown in its normal deflated state in FIG. 5. While referring to both FIGS. 1 and 5 as well as FIG. 3, it can be seen that the inflatable safety apparatus 10 comprises an exterior shell 12 which is shown in cross section in FIG. 3. The exterior shell 12 is preferably constructed of any deformable, elastic yet resilient material (such as those sold under the trade names MYLAR or KEVLAR). The exterior shell 12 as shown forms a sphere having a shell opening 14 located upon the surface of said exterior shell 12. The shell opening 14 further comprises a shell opening perimeter 15.

A chamber 16, shown cylindrical in shape but capable of comprising any variety of shapes, possesses two ends—a bottom end 18 and an open end 20 located opposite therefrom. An open end perimeter 21 is disposed about said open end 20. The chamber 16 is sealed to the exterior shell 12 such that the open end perimeter 21 of the open end 20 of the chamber 16 is sealed (via heat fusing, initial injection molding, etc.) to the shell opening perimeter 15 of the exterior shell 12, as seen clearly in FIGS. 1 through 4. Accordingly, the entire chamber 16, from the bottom end 18 to the open end 20, is contained within the exterior shell 12.

Figure 3:
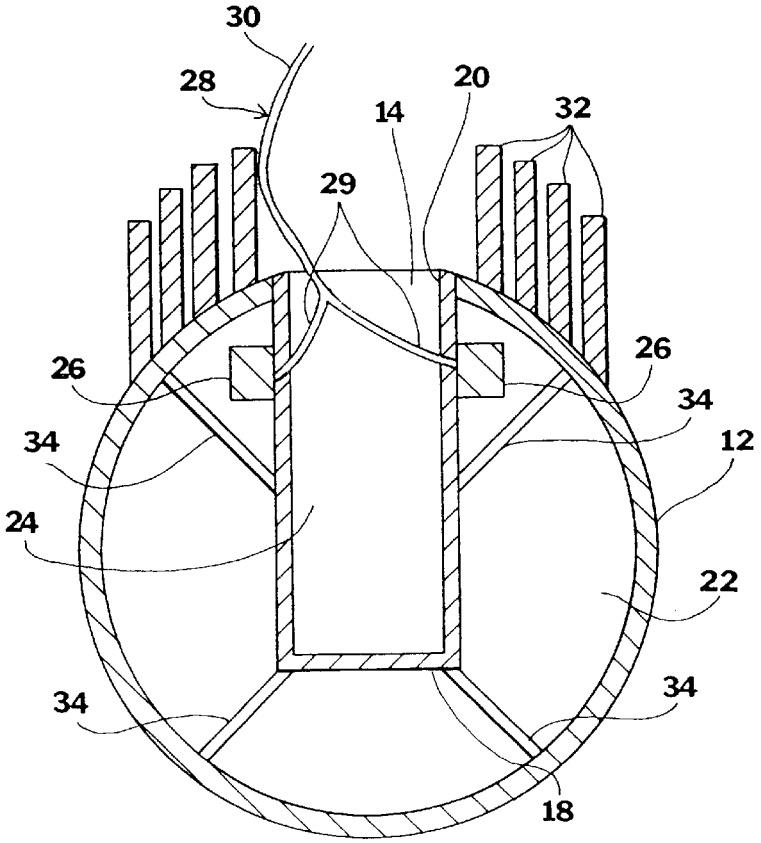
FIG. 3 is a cross sectional view of the inflatable safety apparatus taken on line 3—3 of FIG. 2.

FIG. 3 illustrates that two regions are formed by the co-joining of the chamber 16 to and within the exterior shell 12—an interior shell region 22 and a distinct interior chamber region 24 which is contained within said interior shell region 22. The interior shell region 22 is airtight and capable of retaining high pressure gas therein, so as to allow the accomplishment of a stable state of inflation (as seen in FIGS. 1 and 3 as compared to FIG. 5).

The chamber 16 and hence the interior chamber region 24 are in communication with the exterior environment of the exterior shell 12, such that an individual is capable of entering the chamber 16 from outside the exterior shell 12, via the opening 14 of the exterior shell 12 and the open end of the chamber 16 (the two being integrally sealed together). The reason for an individual doing so will be discussed in detail at a later point.

Figure 5:
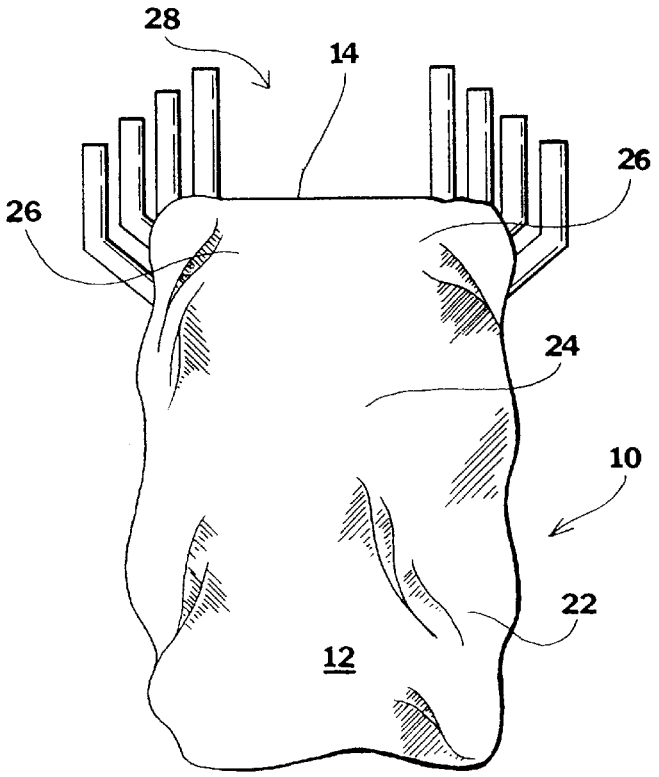
FIG. 5 illustrates the inflatable safety apparatus in a deflated state.

FIG. 5 illustrates inflation means 26 contained within the interior shell region 22 of the exterior shell 12. Said inflation means 26 preferably comprise canisters of compressed gas (such as oxygen, carbon dioxide, helium, etc.) which, when said gas is released, are capable of filling the entire interior shell region 22 and fully inflating the exterior shell 12 as seen in FIG. 3. A tether 28 having an interior end 29 and an exterior end 30 is secured to the inflation means 26 at said interior end 29, such that upon the disengagement of the tether 28 from the inflation means 26, the compressed gas stored therein is released into the interior shell region 22 and the exterior shell 12 is fully inflated.

The inflatable safety apparatus 10 is intended to be used as a safety device for an individual escaping from a dangerous situation at a high altitude (such as from a tall building). In its deflated state, the device is intended to either be carried by the individual while traveling (i.e. while on a business trip and staying in a large hotel) or can optimally be placed proximal to windows, balconies and other means of egress commonly utilized during emergencies in high altitude locations. In the event of an emergency, the individual attempting to escape secures the exterior end 30 of the tether 28 to any fixed object or structural member located nearby. The individual then enters the interior chamber region 24 of the chamber 16 via the open end 20, and exits the building (via a window, over a balcony edge, etc.) to free-fall towards ground level. As the inflatable safety apparatus 10 begins to free-fall, the tether 28 becomes taut until it is caused to disengage from the inflation means 26, thus causing the compressed gas stored therein to be released into the interior shell region 22, causing the exterior shell 12 to be fully inflated.

Figure 4:
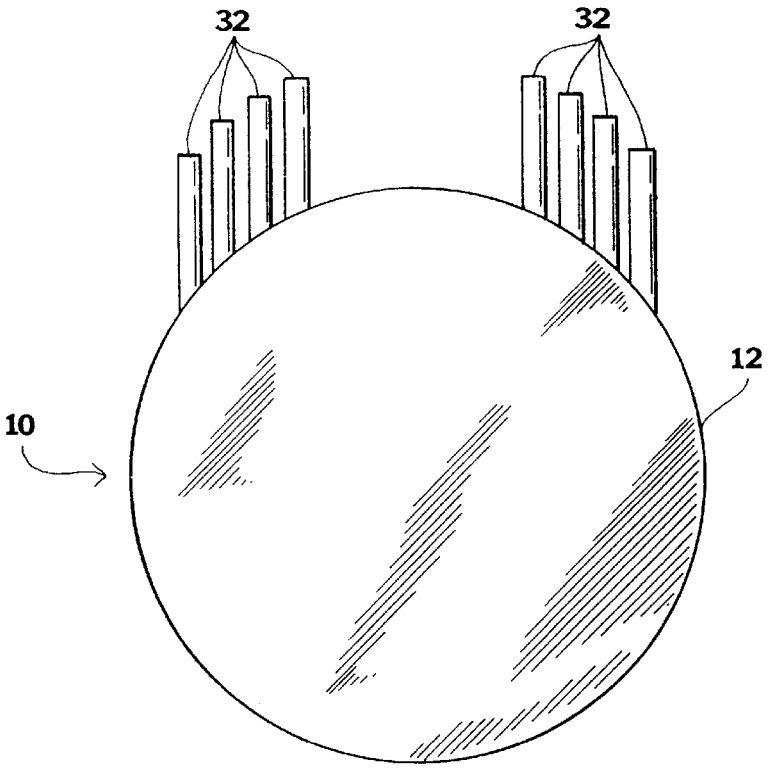
FIG. 4 is a side view of the inflatable safety apparatus, with stabilizing streamers shown extending from the surface thereof.

As the inflatable safety apparatus 10 continues to descend towards the ground in its inflated state as seen in FIG. 4, a plurality of stabilizing streamers 32 which are disposed about the periphery of the exterior shell 12 cause the apparatus to decrease velocity and descend in an upright orientation. In other words, the stabilizing streamers 32 cause the apparatus to descend such that the open end 20 of the chamber 16 remains upright, thus preventing the individual contained within said chamber 16 from falling out. When the inflatable safety apparatus 10 makes contact with the ground, the gas contained within the interior shell region 22 acts as a cushion, preventing undue shock to the individual encapsulated within the chamber 16, and thus preventing injury which would otherwise have been sustained by said individual had the device not been employed. The deformable yet resilient qualities of the material comprising the exterior shell 12 prevent said shell from perforating or puncturing. In addition, as seen in FIG. 3, braces 34 may also be employed and installed within the interior shell region 22 between the chamber 16 and exterior shell 12 to add further rigidity to the device.

What is claimed is:

1. An inflatable safety apparatus, for providing an individual with a safe means of escape from a high altitude location in an emergency situation, comprising:

a) an exterior shell, said exterior shell having a shell opening located thereupon;

b) a chamber, said chamber having an open end and a bottom end located opposite therefrom, the open end of the chamber joined to and in communication with the shell opening, such that the entire chamber, from the bottom end to the open end, is positioned entirely within the exterior shell;

c) an interior chamber region, formed by the co-joining of the open end of the chamber to the shell opening of the exterior shell, said interior chamber region in communication with the environment outside of the exterior shell via the shell opening and open end of the chamber;

d) an interior shell region which surrounds the chamber and is bounded by the exterior shell;

e) inflation means, located within the exterior shell, capable of inflating said exterior shell by filling the interior chamber region with gas, thus providing a safe deformable cushion of gas between the exterior shell and the interior chamber region, wherein the individual may, in the event of an emergency at high altitude, enter the interior chamber region via the shell opening, inflate the exterior shell via the inflation means, and free-fall towards the ground, the individual unharmed by the abrupt contact of the exterior shell with the ground because the individual is encapsulated within the chamber and protected by the surrounding volume of gas which fills the interior shell region, said volume of gas absorbing the impact of the abrupt contact with the ground;

f) a tether, said tether having an interior end and an exterior end located opposite therefrom, the interior end secured to the inflation means such that upon disengagement from said inflation means, the inflation means will inflate the exterior shell, whereby the individual employing the apparatus to escape from a high altitude danger first secures the exterior end of the tether to a fixed object, enters the chamber and then begins decent, thus causing the tether to soon become taught and disengage the inflation means, hence actuating said inflation means; and g) a plurality of stabilizing streamers secured to and extending from the periphery of the exterior shell, said stabilizing streamers forcing the apparatus to decrease velocity and descend in an upright orientation so that the open end of the chamber remains upright, thus preventing the individual contained within said chamber from falling out.

2. An inflatable safety apparatus, for providing an individual with a safe means of escape from a high altitude location in an emergency situation, comprising:

a) an exterior shell, said exterior shell having a shell opening located thereupon;

b) a chamber, said chamber having an open end and a bottom end located opposite therefrom, the open end of the chamber joined to and in communication with the shell opening, such that the entire chamber, from the bottom end to the open end, is positioned entirely within the exterior shell;

c) an interior chamber region, formed by the co-joining of the open end of the chamber to the shell opening of the exterior shell, said interior chamber region in communication with the environment outside of the exterior shell via the shell opening and open end of the chamber;

d) an interior shell region which surrounds the chamber and is bounded by the exterior shell;

e) inflation means, located within the exterior shell, capable of inflating said exterior shell by filling the interior chamber region with gas, thus providing a safe deformable cushion of gas between the exterior shell and the interior chamber region, wherein the individual may, in the event of an emergency at high altitude, enter the interior chamber region via the shell opening, inflate the exterior shell via the inflation means, and free-fall towards the ground, the individual unharmed by the abrupt contact of the exterior shell with the ground because the individual is encapsulated within the chamber and protected by the surrounding volume of gas which fills the interior shell region, said volume of gas absorbing the impact of the abrupt contact with the ground; and f) a plurality of stabilizing streamers secured to and extending from the periphery of the exterior shell, said stabilizing streamers forcing the apparatus to decrease velocity and descend in an upright orientation so that the open end of the chamber remains upright, thus preventing the individual contained within said chamber from falling out.

* * * * *